US011062665B2

(12) United States Patent
Zhang

(10) Patent No.: US 11,062,665 B2
(45) Date of Patent: Jul. 13, 2021

(54) CIRCUIT AND METHOD FOR COMMON VOLTAGE FEEDBACK COMPENSATION AND LIQUID CRYSTAL DISPLAY DEVICE

(71) Applicant: Shenzhen China Star Optoelectronics Semiconductor Display Technology Co., Ltd., Shenzhen (CN)

(72) Inventor: Xianming Zhang, Shenzhen (CN)

(73) Assignees: SHENZHEN CHINA STAR OPTOELECTRONICS, Guangdong (CN); SEMICONDUCTOR DISPLAY TECHNOLOGY CO., LTD., Guangdong (CN)

( * ) Notice: Subject to any disclaimer, the term of this patent is extended or adjusted under 35 U.S.C. 154(b) by 352 days.

(21) Appl. No.: 16/316,613

(22) PCT Filed: Sep. 29, 2018

(86) PCT No.: PCT/CN2018/108646
§ 371 (c)(1),
(2) Date: Jan. 9, 2019

(87) PCT Pub. No.: WO2020/015198
PCT Pub. Date: Jan. 23, 2020

(65) Prior Publication Data

US 2021/0118383 A1 Apr. 22, 2021

(30) Foreign Application Priority Data

Jul. 17, 2018 (CN) ..... 201810785448.7

(51) Int. Cl.
*G09G 3/36* (2006.01)

(52) U.S. Cl.
CPC ..... *G09G 3/3648* (2013.01); *G09G 3/3655* (2013.01); *G09G 2310/0291* (2013.01);
(Continued)

(58) Field of Classification Search
None
See application file for complete search history.

(56) References Cited

U.S. PATENT DOCUMENTS 5,774,099 A * 6/1998 Iwasaki ..... G09G 3/3655 345/87
5,818,402 A * 10/1998 Park ..... G09G 3/3655 345/58

(Continued)

FOREIGN PATENT DOCUMENTS

CN 102842280 A 12/2012
CN 104751809 A 7/2015

(Continued)

*Primary Examiner* — Dorothy Harris
(74) *Attorney, Agent, or Firm* — Leong C. Lei

(57) ABSTRACT

The invention provides a circuit and method for common voltage feedback compensation and LCD. The circuit comprises: a timing controller and a power management circuit, the timing controller and the power management circuit being electrically connected; the timing controller providing a corresponding preset feedback compensation value to the power management circuit under different images; the power management circuit comprising a common voltage compensation circuit and an adder, and the adder integrating the feedback compensation value and a feedback common voltage returned from a feedback point in a display panel through addition obtain an integration result, the common voltage compensation circuit obtaining a common voltage compensation signal based on the integration result and providing the common voltage compensation signal to the display panel. The invention generates the feedback compensation value required for the common voltage feedback and provides to the power management circuit under different images through the timing controller.

15 Claims, 3 Drawing Sheets

(52) U.S. Cl.
CPC . *G09G 2310/08* (2013.01); *G09G 2320/0214* (2013.01); *G09G 2330/021* (2013.01)

(56) References Cited

U.S. PATENT DOCUMENTS 7,542,021 B2 * 6/2009 Kim ..... G09G 3/3655 345/98
8,054,274 B2 * 11/2011 Chen ..... G09G 3/3655 345/96
8,299,995 B2 * 10/2012 Jeong ..... G09G 3/3655 345/89
2002/0180721 A1 * 12/2002 Kimura ..... H01L 27/3269 345/211
2004/0169627 A1 * 9/2004 Hong ..... G09G 5/02 345/89
2006/0145995 A1 * 7/2006 Kim ..... G09G 3/3655 345/98
2007/0146260 A1 * 6/2007 Kang ..... G09G 3/3655 345/87
2010/0110058 A1 * 5/2010 Moh ..... G09G 3/3655 345/211
2011/0102401 A1 * 5/2011 Feng ..... G09G 3/3655 345/211
2013/0314393 A1 * 11/2013 Min ..... G09G 3/3655 345/212
2015/0185744 A1 * 7/2015 Lee ..... G05F 1/461 330/260
2016/0180781 A1 * 6/2016 Kim ..... G06F 3/04184 345/212
2018/0286336 A1 * 10/2018 Wang ..... G09G 3/3696

FOREIGN PATENT DOCUMENTS

CN 105469767 A 4/2016
CN 105551414 A 5/2016
JP 2005234496 A 9/2005
KR 20070094376 A 9/2007

* cited by examiner

CIRCUIT AND METHOD FOR COMMON VOLTAGE FEEDBACK COMPENSATION AND LIQUID CRYSTAL DISPLAY DEVICE

BACKGROUND OF THE INVENTION

1. Field of the Invention

The present invention relates to the field of display, and in particular to a circuit and a method for common voltage feedback compensation and liquid crystal display (LCD) device.

2. The Related Arts

In the LCD panel, a certain degree of leakage exists in the thin film transistor (TFT) and a capacitive effect exists between the TFTs. Thus, the voltages between adjacent data lines are affected by the capacitance, which may affect each other, thereby forming crosstalk phenomenon. The crosstalk generally requires to be improved by compensating the common voltage VCOM to adjust the display effect of the LCD panel.

The compensation of the common voltage VCOM on the common electrode is a technology commonly used by the existing display panel driving. FIG. 1 is a schematic view of a known common voltage compensation circuit. The basic principle is as follows. The feedback point returns the feedback common voltage VCOM_FB in the display panel, through the capacitor C, the AC signal therein is connected to the inverting input terminal of the operational amplifier OP, and reverse feedback is introduced, the common voltage compensation signal VCOM_OUT is outputted from the output terminal of the operational amplifier OP, and the common voltage compensation signal VCOM_OUT is used as the compensated common voltage to be inputted to the display panel. The non-inverting terminal of the operational amplifier OP inputs the reference common voltage VCOM_Ref, and the reference common voltage VCOM_Ref can be from the power management circuit (PMIC) of the display panel. The existing common voltage compensation circuit is mainly for solving the horizontal crosstalk (H-crosstalk) problem.

FIG. 2 shows an example of a commonly used H-crosstalk image and an ideal common voltage compensation diagram. Under this image, if the voltage compensation circuit shown in FIG. 1 is used, the ideal result is The common voltage compensation signal VCOM_OUT and the feedback common voltage VCOM_FB are both leveled to indicate that the common voltage of the display panel is stable.

However, due to coupling of the loading of the panel memory and other signals in the panel, the final result is shown in FIG. 3, which is an example of a commonly used H-crosstalk image and an actual common voltage compensation diagram. After the common voltage compensation circuit shown in FIG. 1 is used, the actual common voltage compensation signal VCOM_OUT and the feedback common voltage VCOM_FB are not leveled in the prior art. That is to say, in this case, due to the limited compensation capability of the common voltage feedback in the prior art, even when compensated, the compensation is not complete, and the common voltage of the display panel is unstable, which causes linear crosstalk of the display panel.

SUMMARY OF THE INVENTION

The object of the present invention is to provide a circuit and a method for common voltage feedback compensation and an LCD device, to improve the H-crosstalk.

To achieve the above object, the present invention provides a circuit for common voltage feedback compensation, comprising: a timing controller and a power management circuit, the timing controller and the power management circuit being electrically connected; the timing controller providing a corresponding preset feedback compensation value to the power management circuit under different images; the power management circuit comprising a common voltage compensation circuit and an adder, and the adder integrating the feedback compensation value and a feedback common voltage returned from a feedback point in a display panel through addition obtain an integration result, the common voltage compensation circuit obtaining a common voltage compensation signal based on the integration result and providing the common voltage compensation signal to the display panel.

Wherein, the feedback compensation value is pre-stored in a flash memory.

Wherein, the timing controller provides, only under a crosstalk image, the corresponding feedback compensation value to the power management circuit for the crosstalk image.

Wherein, the timing controller provides a GND signal as the feedback compensation value to the power management circuit under non-crosstalk images.

Wherein, the adder comprises a first input end, a second input end, and an output end, the first input end inputs the feedback compensation value, the second input end inputs the feedback common voltage, and the output end outputs the addition integration result of the feedback compensation value and the feedback common voltage.

Wherein, the common voltage compensation circuit comprises:

a capacitor having one end connected to the output end of the adder and the other end connected to one end of a first resistor;

the first resistor having the other end connected to an inverting input terminal of an operational amplifier;

a second resistor having one end connected to the inverting input terminal of the operational amplifier and the other end connected to an output terminal of the operational amplifier;

the operational amplifier having a non-inverting input terminal inputting a reference common voltage, and the output terminal outputting a common voltage compensation signal.

The present invention also provides a liquid crystal display device comprising the circuit for common voltage feedback compensation according to any of the above.

The invention also provides a method for common voltage feedback compensation, comprising:

a timing controller providing a corresponding preset feedback compensation value to a power management circuit under different images;

the power management circuit comprising a common voltage compensation circuit and an adder, and the adder integrating the feedback compensation value and a feedback common voltage returned from a feedback point in a display panel through addition obtain an integration result, the common voltage compensation circuit obtaining a common voltage compensation signal based on the integration result and providing the common voltage compensation signal to the display panel.

Wherein, the timing controller provides, only under a crosstalk image, the corresponding feedback compensation value to the power management circuit for the crosstalk image.

Wherein, the timing controller provides a GND signal as the feedback compensation value to the power management circuit under non-crosstalk images.

In summary, the common voltage feedback compensation circuit, method and liquid crystal display device of the invention generate the feedback compensation value required for the common voltage feedback and provides to the power management circuit under different images through the timing controller. As such, the present invention can stabilize the feedback point voltage of the feedback common voltage or close to stability, improve H-crosstalk, and can effectively compensate the common voltage to achieve the best display effect.

BRIEF DESCRIPTION OF THE DRAWINGS

To make the technical solution of the embodiments according to the present invention, a brief description of the drawings that are necessary for the illustration of the embodiments will be given as follows. Apparently, the drawings described below show only example embodiments of the present invention and for those having ordinary skills in the art, other drawings may be easily obtained from these drawings without paying any creative effort. In the drawings.

DETAILED DESCRIPTION OF THE PREFERRED EMBODIMENTS

To further explain the technical means and effect of the present invention, the following refers to embodiments and drawings for detailed description.

Figure 1:
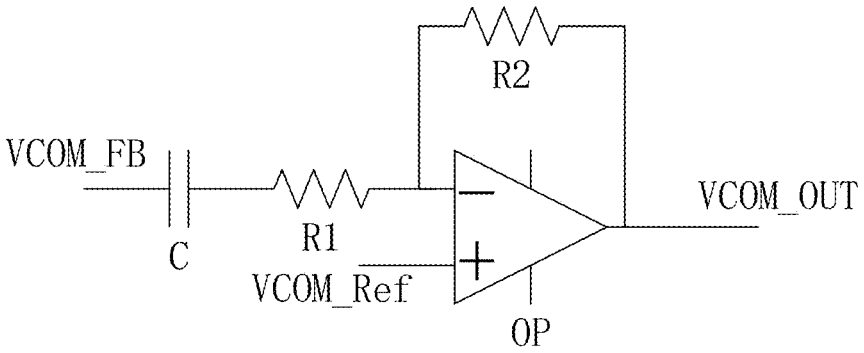
Fig. 1 (Prior Art)
FIG. 1 is a schematic view showing a known common voltage compensation circuit.
Figure 2:
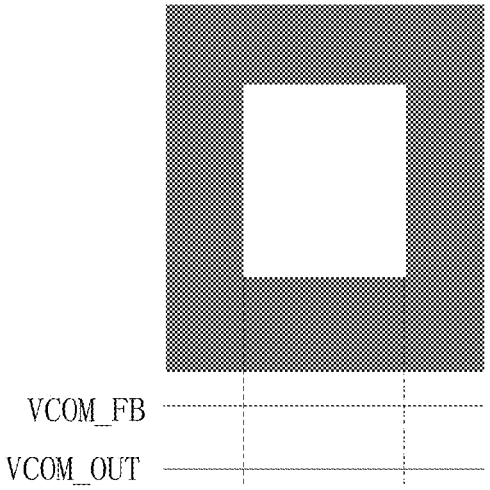
Fig. 2 (Prior Art)
FIG. 2 is a schematic view showing an example of a commonly used H-crosstalk image and an ideal common voltage compensation diagram.
Figure 3:
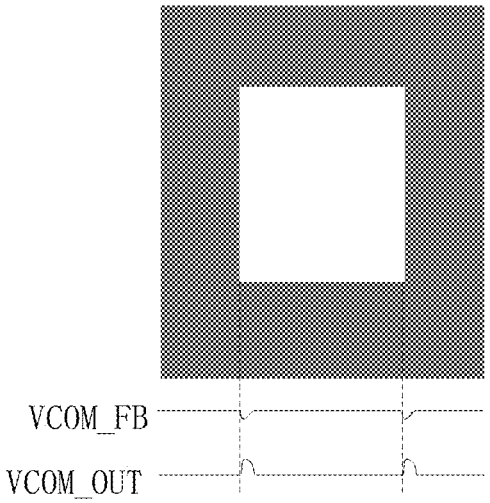
Fig. 3 (Prior Art)
FIG. 3 is a schematic view showing an example of a commonly used H-crosstalk image and an actual common voltage compensation diagram.
Figure 4:
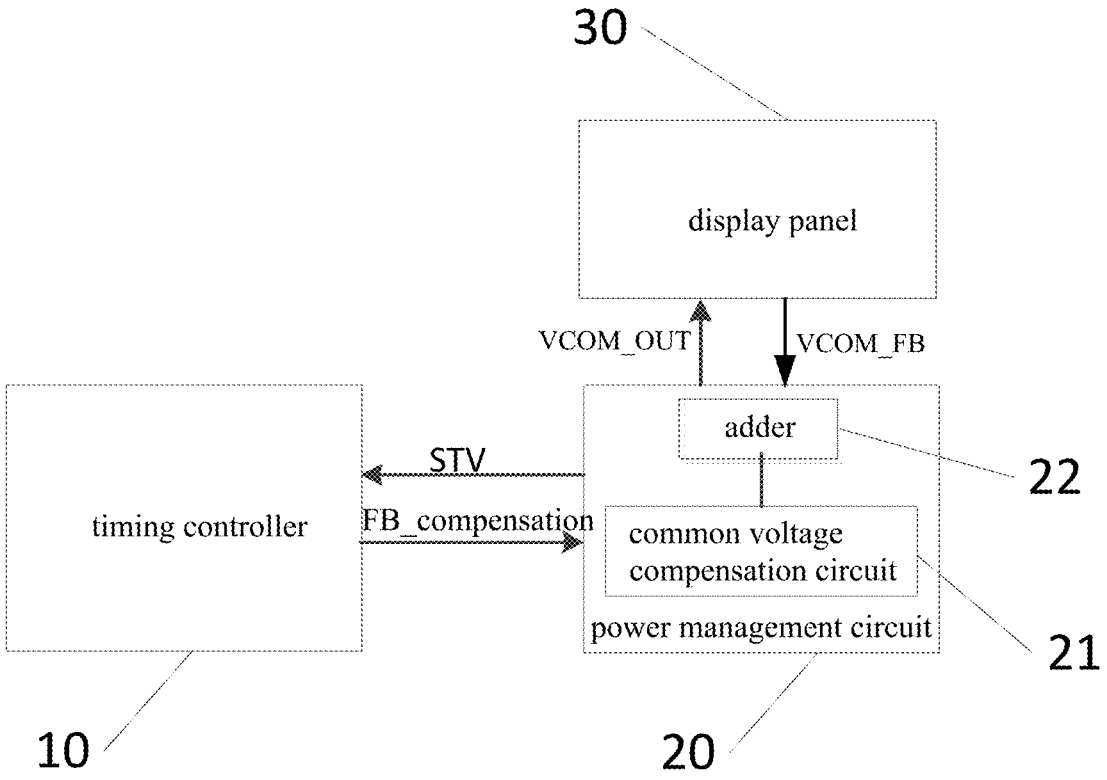
FIG. 4 is a schematic view showing the principle of a preferred embodiment of the circuit for common voltage feedback compensation of the present invention.

Refer to FIG. 4. FIG. 4 is a schematic view showing the principle of a preferred embodiment of the circuit for common voltage feedback compensation of the present invention. The circuit for common voltage feedback compensation of the present invention mainly comprises a timing controller 10 and a power management circuit 20, which are communicatively coupled to each other to transmit various signals, such as, a start signal STV, a feedback compensation value FB_compensation, and so on. When the common voltage feedback compensation circuit of the present invention is applied, the power management circuit 20 is electrically connected to a display panel 30. On one hand, the feedback common voltage VCOM_FB is returned from the feedback point of the display panel 30 to the power management circuit 20, and on the other hand, a common voltage compensation signal VCOM_OUT is used as the compensated common voltage to be inputted to the display panel 30.

The timing controller 10 is configured to provide a corresponding preset feedback compensation value FB_compensation to the power management circuit 20 under different images. The power management circuit 20 comprises a common voltage compensation circuit 21 and an adder 22. The first input end of the adder 22 inputs the feedback compensation value FB_compensation, the second input end inputs the feedback common voltage VCOM_FB, the output end outputs an addition integration result. The feedback compensation value FB_compensation and the feedback common voltage VCOM_FB returned from the feedback point in the display panel 30 are integrated by addition, and the integration result of the feedback common voltage VCOM_FB and the feedback compensation value FB_compensation, instead of the feedback common voltage VCOM_FB, is inputted to the common voltage compensation circuit 21. The common voltage compensation circuit 21 obtains the common voltage compensation signal VCOM_OUT according to the integration result of the feedback compensation value FB_compensation and the feedback common voltage VCOM_FB, and the common voltage compensation signal VCOM_OUT is supplied to the display panel 30. The common voltage feedback compensation circuit of the present invention generate the feedback compensation value FB_compensation required for the common voltage feedback and provides to the power management circuit 20 under different images through the timing controller 10. As such, the present invention can stabilize the feedback point voltage of the feedback common voltage in the display panel 30 or close to stability and improve H-crosstalk.

Figure 5:
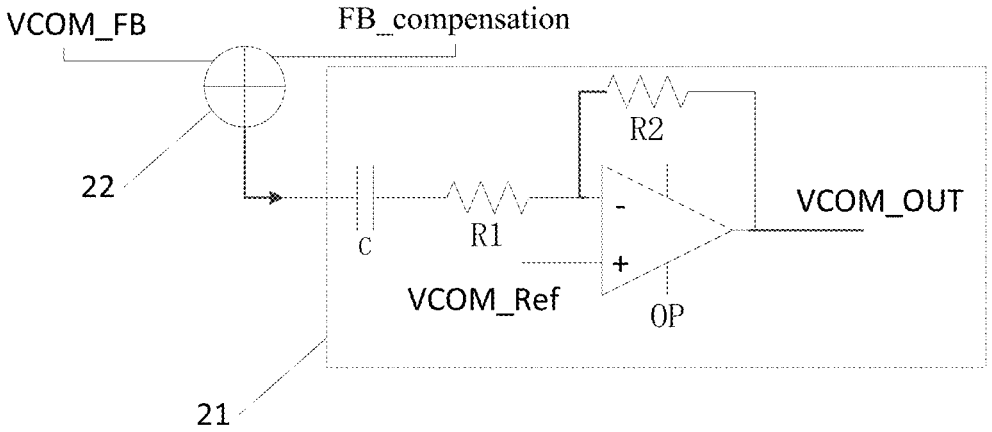
FIG. 5 is a schematic view showing the common voltage compensation circuit and adder in FIG. 4.

Refer to FIG. 5. FIG. 5 is a schematic view showing the common voltage compensation circuit and adder in FIG. 4. The adder 22 adds and integrates the inputted feedback compensation value FB_compensation with the feedback common voltage VCOM_FB, and then inputs the integration result to the common voltage compensation circuit 21. The common voltage compensation circuit 21 mainly comprises: a capacitor C, having one end connected to the integration result of the feedback compensation value FB_compensation and the feedback common voltage VCOM_FB integrated by the addition, and the other end connected to one end of the first resistor R1. The other end of the first resistor R1 is connected to the inverting input terminal of the operational amplifier OP. One end of a second resistor R2 is connected to the inverting input terminal of the operational amplifier OP, and the other end is connected to the output terminal of the operational amplifier OP. The non-inverting input terminal of the operational amplifier OP inputs the reference common voltage VCOM_Ref, and the output terminal outputs the common voltage compensation signal VCOM_OUT after compensated by the operational amplifier OP. The reference common voltage VCOM_Ref may be from the power management circuit 20.

Figure 6:
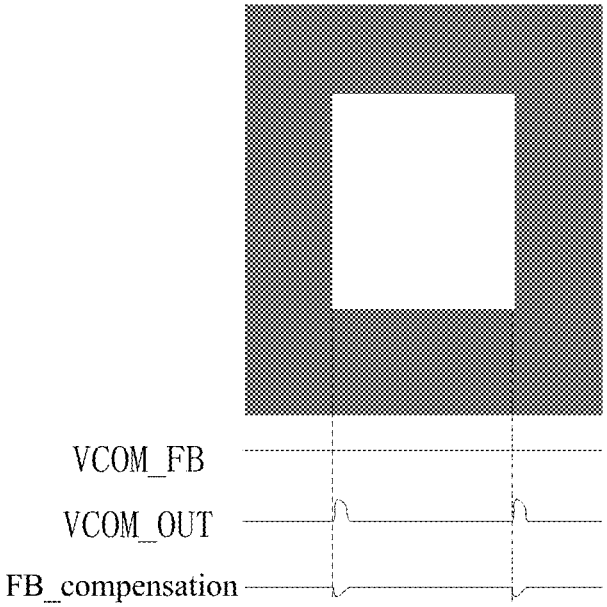
FIG. 6 is a schematic view showing the result of a preferred embodiment of the circuit for common voltage feedback compensation of the present invention.

FIG. 6 is a schematic view showing the result of a preferred embodiment of the circuit for common voltage feedback compensation of the present invention. By using the common voltage feedback compensation circuit of the present invention, under the image shown in upper part of FIG. 6, the common voltage compensation signal VCOM_OUT is obtained by integrating the feedback compensation value FB_compensation with the feedback common voltage VCOM_FB and then entering the common voltage compensation circuit. After the common voltage compensation signal VCOM_OUT is inputted to the display panel, the feedback common voltage VCOM_FB at the feedback point is leveled, which can effectively compensate the common voltage to achieve the best display effect.

In the present invention, the timing controller generates the feedback compensation value FB_compensation required for the common voltage VCOM feedback under different images and provides to the power management circuit, and finally stabilizes the voltage at the feedback point of the feedback common voltage VCOM_FB in the display panel or close to stability, improving the H-crosstalk.

Under different images, the timing controller outputs the corresponding feedback compensation value FB_compensation. The feedback compensation value FB_compensation is obtained by inference and pre-stored in a flash memory under the condition of not introducing the feedback compensation value FB_compensation into the common voltage compensation circuit, according to the actual measured value of the feedback common voltage VCOM_FB compared with the ideal result to be realized; that is, in the absence of the feedback compensation value, as in the prior art, the common voltage compensation circuit, only based on the feedback common voltage returned from the feedback point in the display panel, obtains the common voltage compensation signal and the common voltage compensation signal is provided to the display panel. Then, the required feedback compensation value FB_compensation is inferred in advance according to the actual measured value, and stored and then used in the present invention.

In a preferred embodiment, the timing controller can provide, only under a crosstalk image, a corresponding feedback compensation value to the power management circuit for the crosstalk image. The timing controller can have the corresponding feedback compensation value FB_compensation outputted when detecting the crosstalk image, and at other times, the GND signal is used as the feedback compensation value FB_compensation, and the adder integrates the feedback common voltage VCOM_FB of the feedback point and the GND signal. That is, the present invention is simplified to be possible only for the crosstalk images. When the timing controller detects the crosstalk image, the timing controller directly transmits the compensation value to the power management circuit, or records the compensation value in the power management circuit. The timing controller can inform the power management circuit to make the compensation action, which can also achieve the best display effect. For the non-crosstalk images, the compensation used in prior art can be applied, and the feedback compensation value FB_compensation is not needed.

The present invention also provides a corresponding liquid crystal display device comprising the above-described circuit for common voltage feedback compensation.

The invention also provides a method for common voltage feedback compensation, comprising:

a timing controller providing a corresponding preset feedback compensation value to a power management circuit under different images;

the power management circuit comprising a common voltage compensation circuit and an adder, and the adder integrating the feedback compensation value and a feedback common voltage returned from a feedback point in a display panel through addition obtain an integration result, the common voltage compensation circuit obtaining a common voltage compensation signal based on the integration result and providing the common voltage compensation signal to the display panel.

The feedback compensation value can be obtained in advance by the following process: without the feedback compensation value, the common voltage compensation circuit obtains the common voltage compensation signal only according to the feedback common voltage drawn back from the feedback point in the display panel and provides a common voltage compensation signal to the display panel, the required feedback compensation value in inferred based on the actual measured value of the feedback common voltage.

The timing controller provides, only under a crosstalk image, the corresponding feedback compensation value to the power management circuit for the crosstalk image.

In summary, the common voltage feedback compensation circuit, method and liquid crystal display device of the invention generate the feedback compensation value required for the common voltage feedback and provides to the power management circuit under different images through the timing controller. As such, the present invention can stabilize the feedback point voltage of the feedback common voltage or close to stability, improve H-crosstalk, and can effectively compensate the common voltage to achieve the best display effect.

It should be noted that in the present disclosure the terms, such as, first, second are only for distinguishing an entity or operation from another entity or operation, and does not imply any specific relation or order between the entities or operations. Also, the terms "comprises", "include", and other similar variations, do not exclude the inclusion of other non-listed elements. Without further restrictions, the expression "comprises a . . . " does not exclude other identical elements from presence besides the listed elements.

Embodiments of the present invention have been described, but not intending to impose any unduly constraint to the appended claims. Any modification of equivalent structure or equivalent process made according to the disclosure and drawings of the present invention, or any application thereof, directly or indirectly, to other related fields of technique, is considered encompassed in the scope of protection defined by the claims of the present invention.

What is claimed is:

1. A circuit for common voltage feedback compensation, comprising: a timing controller and a power management circuit, the timing controller and the power management circuit being electrically connected; the timing controller providing a feedback compensation value to the power management circuit under different images; the power management circuit comprising a common voltage compensation circuit and an adder, and the adder integrating the feedback compensation value and a feedback common voltage returned from a feedback point in a display panel that displays the different images through addition to provide an integration result, the common voltage compensation circuit obtaining a common voltage compensation signal based on the integration result and providing the common voltage compensation signal to the display panel, wherein the feedback compensation value is determined according to the feedback common voltage returned from the display panel.

2. The circuit for common voltage feedback compensation as claimed in claim 1, wherein the feedback compensation value is pre-stored in a flash memory.

3. The circuit for common voltage feedback compensation as claimed in claim 1, wherein the different images displayed on the display panel include a crosstalk image that is an image affected by crosstalking among components of the display panel and a non-crosstalk image that is an image not affected by crosstalking among the components of the display panel, and wherein the timing controller provides the feedback compensation value that is determined according to the feedback common voltage returned from the display panel displaying the crosstalk image to the power management circuit for the crosstalk image.

4. The circuit for common voltage feedback compensation as claimed in claim 3, wherein the timing controller is operable to set the feedback compensation value as a grounding signal to provide to the power management circuit for the display panel displaying the non-crosstalk image.

5. The circuit for common voltage feedback compensation as claimed in claim 1, wherein the adder comprises a first input end, a second input end, and an output end, the first input end inputs the feedback compensation value, the second input end inputs the feedback common voltage, and the output end outputs the addition integration result of the feedback compensation value and the feedback common voltage.

6. The circuit for common voltage feedback compensation as claimed in claim 1, wherein the common voltage compensation circuit comprises:

a capacitor having one end connected to the output end of the adder and the other end connected to one end of a first resistor;

the first resistor having the other end connected to an inverting input terminal of an operational amplifier;

a second resistor having one end connected to the inverting input terminal of the operational amplifier and the other end connected to an output terminal of the operational amplifier;

the operational amplifier having a non-inverting input terminal inputting a reference common voltage, and the output terminal outputting a common voltage compensation signal.

7. A liquid crystal display (LCD) device, comprising a circuit for common voltage feedback compensation, the circuit for common voltage feedback compensation comprising: a timing controller and a power management circuit, the timing controller and the power management circuit being electrically connected; the timing controller providing a feedback compensation value to the power management circuit under different images; the power management circuit comprising a common voltage compensation circuit and an adder, and the adder integrating the feedback compensation value and a feedback common voltage returned from a feedback point in a display panel that displays the different images through addition to provide an integration result, the common voltage compensation circuit obtaining a common voltage compensation signal based on the integration result and providing the common voltage compensation signal to the display panel, wherein the feedback compensation value is determined according to the feedback common voltage returned from the display panel.

8. The LCD device as claimed in claim 7, wherein the feedback compensation value is pre-stored in a flash memory.

9. The LCD device as claimed in claim 7, wherein the different images displayed on the display panel include a crosstalk image that is an image affected by crosstalking among components of the display panel and a non-crosstalk image that is an image not affected by crosstalking among the components of the display panel, and wherein the timing controller provides the feedback compensation value that is determined according to the feedback common voltage returned from the display panel displaying the crosstalk image to the power management circuit for the crosstalk image.

10. The LCD device as claimed in claim 9, wherein the timing controller is operable to set the feedback compensation value as a grounding signal to provide to the power management circuit for the display panel displaying the non-crosstalk image.

11. The LCD device as claimed in claim 7, wherein the adder comprises a first input end, a second input end, and an output end, the first input end inputs the feedback compensation value, the second input end inputs the feedback common voltage, and the output end outputs the addition integration result of the feedback compensation value and the feedback common voltage.

12. The LCD device as claimed in claim 7, wherein the common voltage compensation circuit comprises:

a capacitor having one end connected to the output end of the adder and the other end connected to one end of a first resistor;

the first resistor having the other end connected to an inverting input terminal of an operational amplifier;

a second resistor having one end connected to the inverting input terminal of the operational amplifier and the other end connected to an output terminal of the operational amplifier;

the operational amplifier having a non-inverting input terminal inputting a reference common voltage, and the output terminal outputting a common voltage compensation signal.

13. A method for common voltage feedback compensation, comprising:

a timing controller providing a feedback compensation value to a power management circuit under different images;

the power management circuit comprising a common voltage compensation circuit and an adder, and the adder integrating the feedback compensation value and a feedback common voltage returned from a feedback point in a display panel that displays the different images through addition to provide an integration result, the common voltage compensation circuit obtaining a common voltage compensation signal based on the integration result and providing the common voltage compensation signal to the display panel, wherein the feedback compensation value is determined according to the feedback common voltage returned from the display panel.

14. The method for common voltage feedback compensation as claimed in claim 13, wherein the different images displayed on the display panel include a crosstalk image that is an image affected by crosstalking among components of the display panel and a non-crosstalk image that is an image not affected by crosstalking among the components of the display panel, and wherein the timing controller provides the feedback compensation value that is determined according to the feedback common voltage returned from the display panel displaying the crosstalk image to the power management circuit for the crosstalk image.

15. The method for common voltage feedback compensation as claimed in claim 14, wherein the timing controller is operable to set the feedback compensation value as a grounding signal to provide to the power management circuit for the display panel displaying the non-crosstalk image.

* * * * *